US005378115A

United States Patent [19]

Fujii et al.

[11] Patent Number: 5,378,115

[45] **Date of Patent: * Jan. 3, 1995**

[54] SWASH PLATE TYPE COMPRESSOR

[75] Inventors: Toshiro Fujii; Hitoshi Inukai; Kazuaki Iwama, all of Kariya, Japan

[73] Assignee: Kabushiki Kaisha Toyoda Jidoshokki Seisakusho, Kariya, Japan

[ * ] Notice: The portion of the term of this patent subsequent to Nov. 29, 2011 has been disclaimed.

[21] Appl. No.: 101,178

[22] Filed: Aug. 3, 1993

[30] Foreign Application Priority Data

Aug. 7, 1992 [JP] Japan ..... 4-211168

[51] Int. Cl.[6] ..... F04B 1/12

[52] U.S. Cl. ..... 417/269; 184/6.17

[58] Field of Search ..... 417/269; 184/6.17; 91/480, 490, 502

[56] References Cited

U.S. PATENT DOCUMENTS

| | | | |
|---|---|---|---|
| 1,925,378 | 9/1933 | Ferris et al. | 91/484 X |
| 2,160,978 | 6/1939 | Mock | 417/269 |
| 3,823,557 | 7/1974 | Van Wagenen et al. | 417/269 |
| 5,207,078 | 5/1993 | Kimura et al. | 417/269 |
| 5,232,349 | 8/1993 | Kimura et al. | 417/269 |

FOREIGN PATENT DOCUMENTS

| | | | |
|---|---|---|---|
| 3-92587 | 4/1991 | Japan . | |
| 4311683 | 11/1992 | Japan | 417/269 |

*Primary Examiner*—Richard A. Bertsch
*Assistant Examiner*—M. Kocharov
*Attorney, Agent, or Firm*—Brooks Haidt Haffner & Delahunty

[57] ABSTRACT

A swash plate type compressor comprises a cylinder block cooperating to form therein a compartment accommodating therein a swash plate and also serving as a suction chamber of the compressor, and a drive shaft rotatably supported in the cylinder block and having formed therein an axial discharge passage connecting front and rear discharge chambers. The compressor further includes a pair of front and rear rotary type suction valves mounted on the drive shaft for rotation therewith and fitted in bores formed centrally in the cylinder block such that one axial end thereof is exposed to suction pressure and the other end to discharge pressure of the refrigerant gas. Each suction valve has formed therein a passage which is in constant communication with the swash plate compartment and is operable to bring its passage in communication successively with fluid working chambers in synchronism with the rotation of the drive shaft. The drive shaft is formed with a lubricating oil hole extending radially from its central discharge passage to its outer periphery and directed to feed lubricating oil toward the sliding contact surfaces between the suction valve and its accommodation bore.

8 Claims, 5 Drawing Sheets

SWASH PLATE TYPE COMPRESSOR

FIELD OF THE INVENTION

The present invention relates to a multi-cylinder, swash plate type refrigerant compressor for use in an automotive air conditioning system.

BACKGROUND OF THE INVENTION

Swash plate type refrigerant compressor of a typical structure is disclosed, e.g., by Publication of Japanese Patent Application No. 3-92587 (1991), which includes front and rear cylinder blocks axially combined together to form a cylinder block assembly and having defined therein a plurality of pairs of aligned cylinder bores, a reciprocable double-headed piston fitted in each paired cylinder bores, front and rear housings bolted to the axial ends of the cylinder block assembly with a valve plate interposed between each housing and its adjacent cylinder block assembly end. The compressor further includes a drive shaft which is rotatably supported by bearings in the cylinder block assembly, and a swash plate fixedly mounted on the drive shaft at an angle of inclination for rotary wobbling movement in a swash plate compartment in the cylinder block assembly. The swash plate compartment communicates with a gas inlet fitting provided on the cylinder block assembly and connected to an external conduit through which refrigerant gas under a suction pressure is supplied to the compressor. Each double-headed piston is engaged with the swash plate by way of a pair of front and rear hemispherical shoes such that the wobbling movement of the swash plate is converted into reciprocating movement of the piston in its corresponding paired cylinder bores.

A pair of front and rear suction chambers are defined by the front and rear housings and their adjacent valve plates, respectively, and the swash plate compartment filled with refrigerant gas under suction pressure is connected with these front and rear suction chambers through a plurality of suction passages formed to extend axially through the respective cylinder blocks between any two circumferentially adjacent cylinder bores. Similarly, a pair of front and rear discharge chambers are formed on opposite ends of the compressor by the housings and the valve plates, respectively. These discharge chambers are connected to each other by way of passages extending axially through the cylinder block assembly so that compressed refrigerant gas discharged into one of the discharge chambers flows into the other discharge chamber, from where it is delivered out of the compressor together with refrigerant gas forced out directly into the above other discharge chamber.

Each valve plate has a flap or reed type suction valve for each cylinder bore, whose reed is flexible and operable to open a suction port in the valve plate during the suction stroke of the piston by a pressure differential then created between the suction chamber and the fluid working chamber associated with the piston. In the above-described swash plate type compressor, pressor, the refrigerant gas contains in it an appropriate amount of lubricating oil entrained thereby through the compressor in the form of a mist to lubricate various parts of the compressor such as bearings, sliding surfaces of parts. It is noted, however, that part of the oil sticks to the seat surface with which the suction valve reed is in contact when closed and that such oil offers resistance to the suction valve when its reed commences to be resiliently deformed or bent open by the pressure differential when the piston is moved for its suction stroke.

Because the flexible suction valve reed has to be resiliently bent to open the suction port, the pressure differential must be great enough to cause the reed to bend. That is, the reed itself, when it opens the suction port, offers resistance against the flow of refrigerant gas to be admitted into the cylinder bore. These resistances due to the lubricating oil and the reed itself cause a delay in opening of the suction valve thereby reducing the volume of refrigerant gas admitted into the fluid working chamber during the piston's suction stroke, with the result that volumetric efficiency of the compressor is reduced accordingly. Furthermore, the axial passages formed in the cylinder blocks extending between the swash plate compartment and the front and rear suction chambers cause a pressure loss of refrigerant gas passing therethrough, thereby affecting the working efficiency of the compressor.

It is noted that, for any given diameter of cylinder bores in a compressor, the bores should be arranged and spaced apart circumferentially from each other in the cylinder block assembly at such a spaced distance that maintains the desired wall thickness between any two circumferentially adjacent cylinder bores for ensuring the overall strength and durability of the cylinder block assembly. Arranging the cylinder bores radially toward the outer periphery of the cylinder block assembly with an attempt to increase the wall thickness will enlarge the assembly radially, thereby making the compressor disadvantageously larger in size. On the other hand, if the cylinder bores are arranged toward the axial center of the cylinder block assembly with an attempt to reduce the compressor size, the compressor strength will be in turn deteriorated by reduced wall thickness. As understood by those skilled in the art, the suction and discharge passages extending axially in the cylinder blocks are disadvantageous in that the presence of such passages reduces the wall thickness and, therefore, it is difficult to maintain the cylinder block assembly strength while achieving compactness of the compressor.

SUMMARY OF THE INVENTION

It is an object of the present invention, therefore, to provide a swash plate type refrigerant compressor which can solve the above-mentioned problems.

The above object of the invention can be accomplished by a swash plate type compressor which comprises a cylinder block having formed therein a compartment accommodating therein a swash plate and also serving as a suction chamber of the compressor and a plurality of cylinder bores, each receiving therein a reciprocally movable double-headed piston, and a drive shaft having formed therein an axial discharge passage in communication with front and rear discharge chambers in front and rear housings, respectively, which are fastened to the axial ends of the cylinder block with a valve plate interposed between each of the housings and its adjacent end of the cylinder block.

The compressor further includes a pair of front and rear rotary type suction valves fitted axially and slidably in bores formed centrally in the cylinder block such that one axial end of each suction valve is exposed to suction pressure and the other end thereof to discharge pressure of refrigerant gas. Each suction valve is mounted on the drive shaft for rotation therewith and has formed therein a fluid passage which is in constant communication with the swash plate compartment and communicable with the respective cylinder bores by rotation of the valve. That is, it is so arranged that the suction valve is operable to bring its fluid passage in communication successively with fluid working chambers of the compressor in synchronism with rotation of the drive shaft to admit refrigerant gas in the swash plate compartment into the respective fluid working chambers through the fluid passage.

According to one preferred embodiment of the invention, each suction valve has an outer peripheral surface tapered inward in sliding contact with a complementarily tapered peripheral surface of its central accommodation bore in the cylinder block and is disposed in the bore with its larger end exposed to discharge pressure and the opposite small end to suction pressure so that the suction valve is biased inward by the suction-discharge pressure differential.

The drive shaft is supported by a pair of front and rear tapered roller bearings disposed adjacent and outward of the respective suction valves. The drive shaft is formed with a lubricating oil hole extending radially from its central axial discharge passage to its outer periphery so as to be directed to feed lubricating oil toward the sliding contact surfaces between the suction valve and its accommodation bore and also to the bearings. The lubricating oil penetrated into the clearance between the above sliding contact surfaces does not only lubricate the same surfaces, but also provides an effective sealant for the suction valve.

The above and other objects and features of the invention will be apparent from the following detailed description of the preferred embodiment thereof in conjunction with the accompanying drawings.

DETAILED DESCRIPTION OF PREFERRED EMBODIMENT

Figure 1:
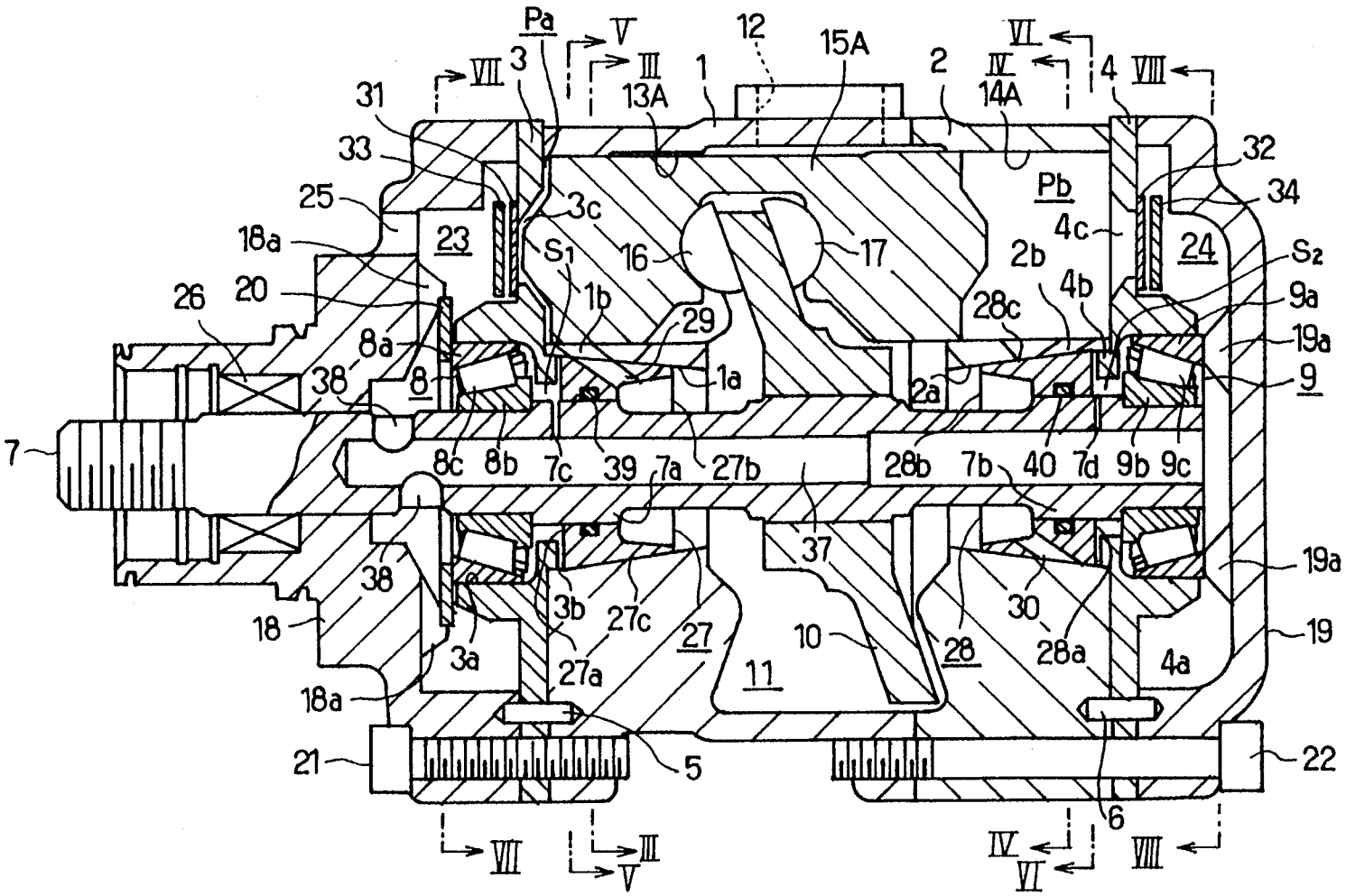
FIG. 1 is a longitudinal cross-sectional view of a multi-cylinder, swash plate type refrigerant compressor constructed according to the present invention.

Referring to FIG. 1, there is illustrated a compressor constructed according to the present invention, which includes a pair of front and rear cylinder blocks 1, 2 sealingly combined together to provide a cylinder block assembly and cooperating to form therein a desired number of pairs (five pairs in the embodiment as seen clearly in FIGS. 3, 4) of front and rear cylinder bores 13, 14 (13A, 14A) which are angularly equally spaced round and in parallel to a drive shaft 7 rotatably supported by front and rear tapered roller bearings 8, 9, each comprising a plurality of taper rollers 8*c*, 9*c*, outer race 8*a*, 9*a*, and inner race 8*b*, 9*b*, respectively. The front and rear cylinder bores 13, 14 of each pair are axially aligned to form a single cylinder bore and receiving therein a double-headed, or double-acting piston 15 (15A) fitted for reciprocal sliding movement in its associated paired cylinder bores. The cylinder blocks 1, 2 are formed with two central bores 1*a*, 2*a* for accommodating therein rotary type suction valves 27, 28 which will be described in detail in later part hereof.

The compressor further includes a front housing 18 which is sealingly fastened to the front end of the cylinder block assembly by a plurality of bolts 21 with a valve plate 3 interposed between the housing and the cylinder block assembly front end. Similarly, a rear housing 19 is clamped to the rear end of the assembly together with a valve plate 4 by a plurality of bolts 22. The valve plates 3, 4 have annular projections defining central bores 3*a*, 4*a* for supporting therein the tapered roller bearings 8, 9, and annular portions 3*b*, 4*b* protruding radially inward to provide annular shoulder portions which are engaged with outer peripheral edges of the respective suction valve accommodating bores 1*a*, 2*a* to locate the valve plates radially with respect to cylinder block assembly. Locating pins 5, 6 are inserted through holes drilled in the cylinder blocks 1, 2, valve plates 3, 4 and housings 18, 19 to keep the valve plates from rotating.

The front and rear cylinder blocks 1, 2 cooperate to define therein a compartment 11 for accommodating a circular swash plate 10. The swash plate 10 is fixedly mounted on the drive shaft 7 at a predetermined angle of inclination so that the plate makes a rotational wobbling movement in its compartment 11 when driven to rotate by the drive shaft. The swash plate 10 drivably engages the center of each double-headed piston 15 by way of a pair of front and rear hemispherical shoes 16, 17 such that the rotational wobbling movement of the swash plate caused by rotation of the drive shaft 7 is converted into reciprocal movement of the piston in its paired cylinder bores, thus variable-volume fluid working chambers P (Pa, Pb) being formed on opposite sides of the double-headed piston 15 (15A).

There is provided a refrigerant gas inlet fitting on the periphery of the front cylinder block 1, whose port 12 is connected on one hand to an external refrigerant gas conduit (not shown) and, on the other to the swash plate compartment 11. Thus, the swash plate compartment 11 is filled with refrigerant gas under suction pressure and, therefore, it serves also as a suction chamber of the compressor.

Figure 7:
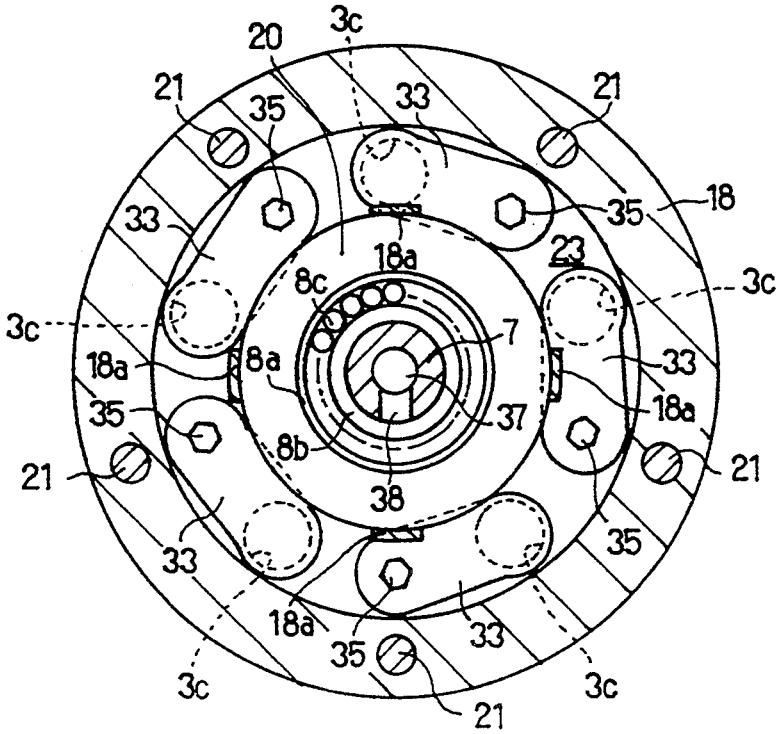
FIG. 7 is a cross-sectional view taken along line VII—VII of FIG. 1 through a front housing of the compressor.
Figure 8:
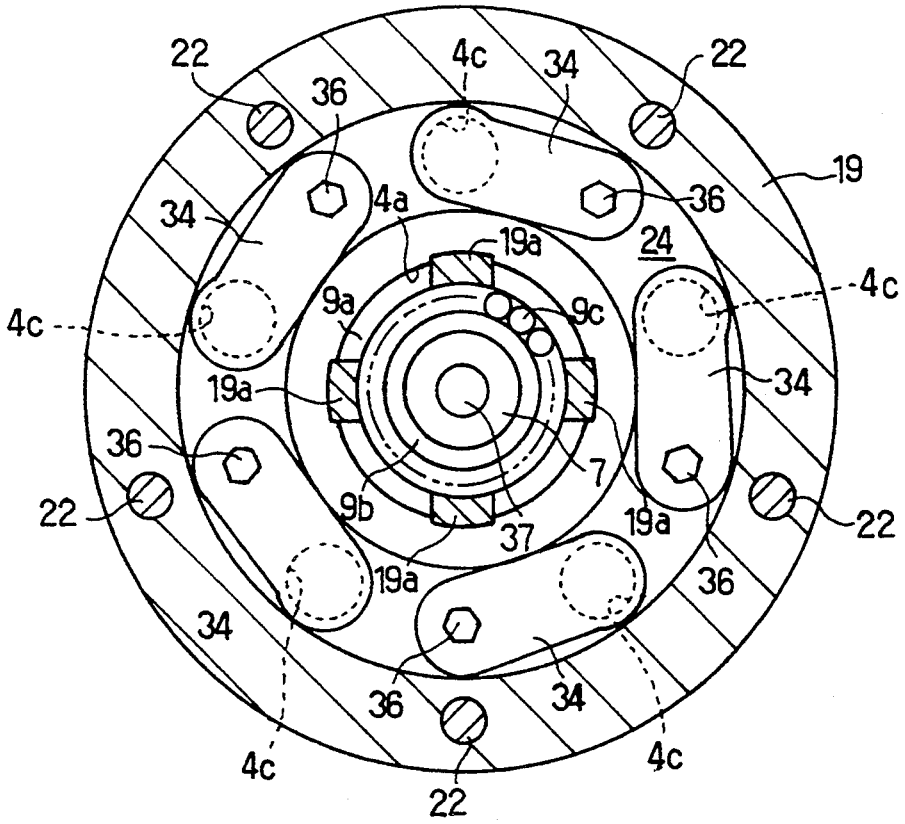
FIG. 8 is a cross-sectional view which is similar to FIG. 7, but taken along line VIII—VIII of FIG. 1 through a rear housing of the compressor.

The front and rear housings 18, 19 cooperate with the valve plates 3, 4 to form therein discharge chambers 23, 24, respectively, which are communicable with the respective cylinder bores through discharge ports 3*c*, 4*c* formed through the valve plates. The valve plates 3, 4 include reed type discharge valves 31, 32 for controlling the flow of refrigerant gas discharged through the ports 3*c*, 4*c* into the respective discharge chambers 23, 24. and retainers 33, 34 for restricting the maximum degree of opening of the discharge valve reeds. As shown in FIGS. 7 and 8, each reed valve and its retainer are fastened together to the valve plate by a bolt 35, 36. The discharge chamber 23 in the front housing 18 has a delivery passage 25 which is connected to an external delivery conduit (not shown).

As shown clearly in FIG. 1, the front end of the drive shaft 7 extends through the front housing 18 and has a lip seal 26 mounted thereon to seal the shaft against leakage of compressed refrigerant gas, while the opposite rear end extends to the discharge chamber 24 in the rear housing 19. The drive shaft 7 has formed therein an axial central passage 37 which is opened at its rear end to the discharge chamber 24 and at the opposite end to the discharge chamber 23 through a plurality of holes 38 formed radially in the drive shaft. Thus, the front and rear discharge chambers 23, 24 are in direct communication with each other through the axial passage 37 and the holes 38 in the drive shaft 7, so that compressed refrigerant gas forced out into the rear discharge chamber flows through the axial and radial passages to the front discharge chamber from where it is delivered out through the delivery passage 25 together with gas compressed and discharged directly into the front discharge chamber.

As shown in FIGS. 1, 7 and 8, the front and rear housings 18, 19 are formed on their inner surfaces with a plurality of projections 18*a*, 19*a*. The projections 19*a* in the rear housing abut against the outer race 9*a* of the rear tapered roller bearing 9, whose inner race 9*b* is held by an annular shoulder portion formed at outer end of an enlarged section 7*b* on the drive shaft 7. Between the projections 18*a* in the front housing and the front tapered roller bearing 8 is disposed an annular preloading spring 20 with its outer peripheral edge held by shoulder portions of the projections 18*a* and its inner peripheral edge set in abutment engagement with the outer race 8*a* of the front bearing, whose inner race 8*b* is held by an annular shoulder portion formed at the outer end of another enlarged section 7*a* on the drive shaft. By so arranging, thrust pressure exerted by the drive shaft 7 rightward, as viewed in FIG. 1, is carried by the rear housing 19 by way of the rear bearing 9 and the thrust leftward is supported by the front housing 18 via the bearing 8 and the preloading spring 20. The spring 20 is yieldably deformed when the front housing 18, valve plate 3 and cylinder block 1 are tightened together by the bolts 21, thereby providing an axial preload to the drive shaft 7 via the bearing 8.

Figure 2:
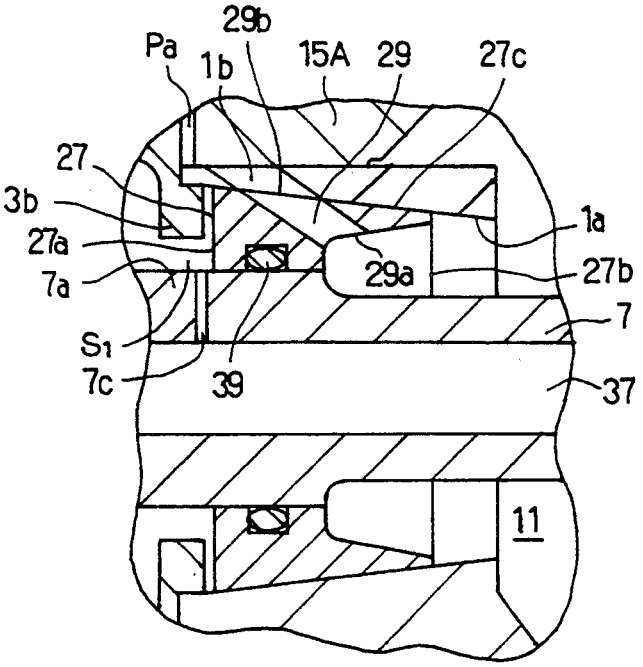
FIG. 2 is an enlarged view showing a front suction valve mounted on a drive shaft of the compressor of FIG. 1.
Figure 3:
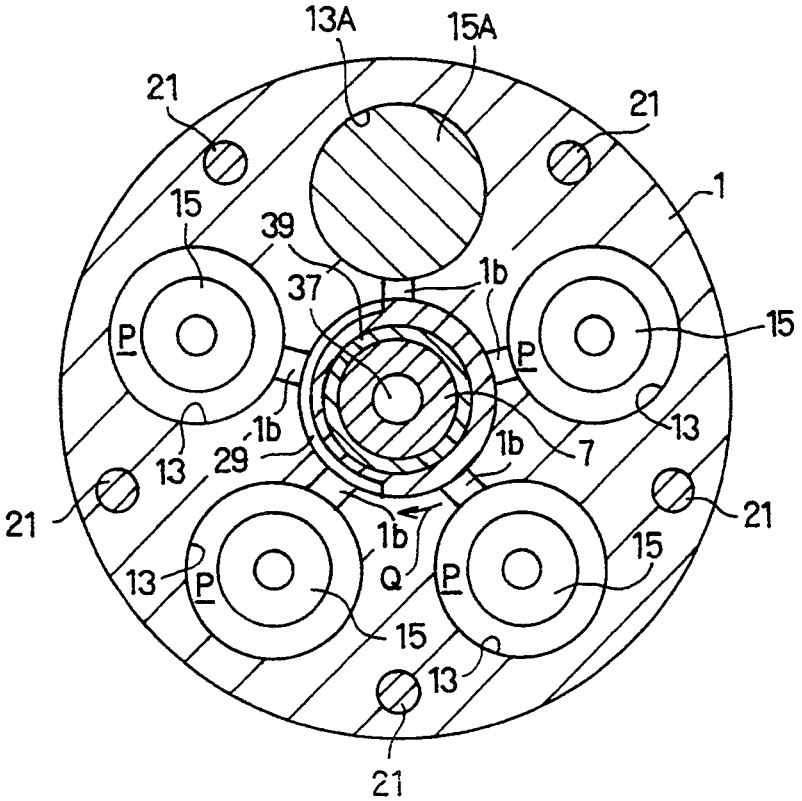
FIG. 3 is a cross-sectional view taken along line III—III of FIG. 1 through a front cylinder block and the front suction valve of the compressor.

The above-mentioned rotary suction valves 27, 28. which are accommodated in the bores 1*a*, 2*a*, are mounted on the enlarged sections 7*a*, 7*b*, of the drive shaft with seal rings 39, 40, respectively, by way of keys (not shown) for rotation with the drive shaft in the direction indicated by arrow Q in FIG. 3, but are axially slidably along the shaft. As shown most clearly in FIG. 2, the suction valve 27 is tapered inward, having a larger-diameter portion 27*a* adjacent the discharge chamber 23 and a smaller-diameter portion 27*b* adjacent the swash plate compartment 11, respectively, and the periphery of the valve accommodating bore la is complementarily configured so that the valve fits snugly in its bore. The same is true of the rear suction valve 28 and its corresponding bore 2*a*. As shown in FIGS. 1, 2, 3 and 4, the suction valves 27, 28 have formed therein fluid passages 29, 30 each having an inlet 29*a*, 30*a* which is in direct communication with the suction chamber, or the swash plate compartment 11, and an outlet 29*b*, 30*b* which is opened to the outer periphery 27*c*, 28*c* of the suction valve and communicable with the cylinder bores, as will be explained below.

As shown in FIGS. 2 and 3, as many suction ports 1*b* as the cylinder bores 13, 13A are formed obliquely in the cylinder block 1 at the same angularly spaced intervals as the cylinder bores. Each suction port 1*b* extends between its associated cylinder bore and the periphery of the central bore 1*a* such that the fluid passage 29 in the rotatable suction valve 27 can be in registration with the suction port thereby to fluidly communicate the swash plate compartment 11 with the cylinder bore through the fluid passage 29 and the port 1*b* depending on where the piston is positioned in the cylinder bore. As understood readily from FIG. 4 which is similar to FIG. 3, suction ports 2*b* in the rear suction valve 28 are formed and operable in the same manner as the above suction ports 1*b* in the front suction valve 27.

Figure 4:
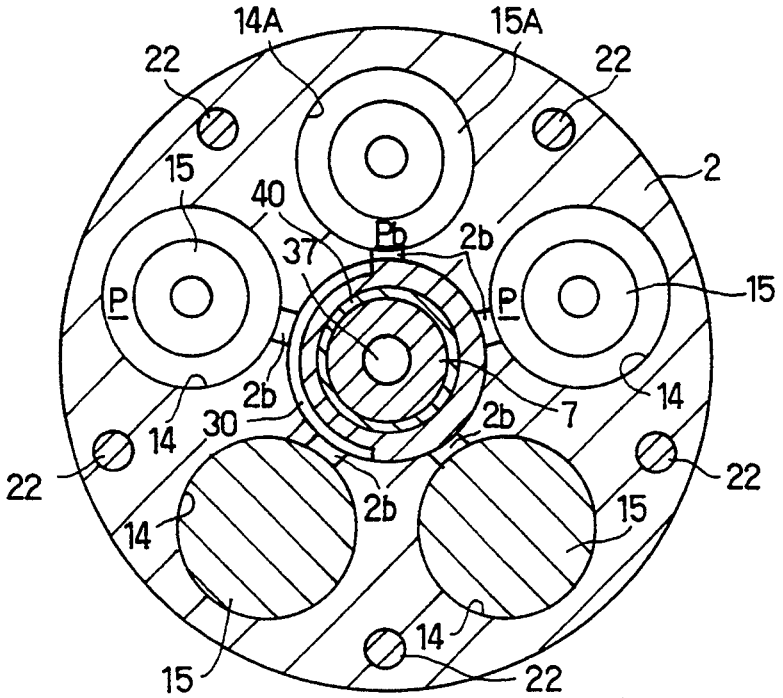
FIG. 4 is a cross-sectional view which is similar to FIG. 3, but taken along line IV—IV of FIG. 1 through a rear cylinder block and a rear suction valve of the compressor.
Figure 5:
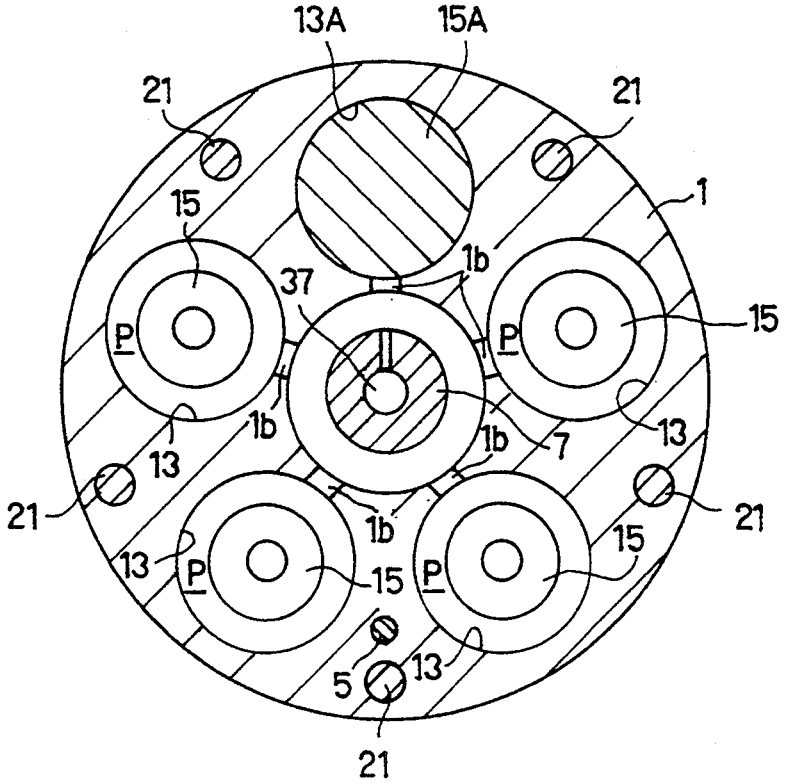
FIG. 5 is a cross-sectional view taken along line V—V of FIG. 1 through the front cylinder block.
Figure 6:
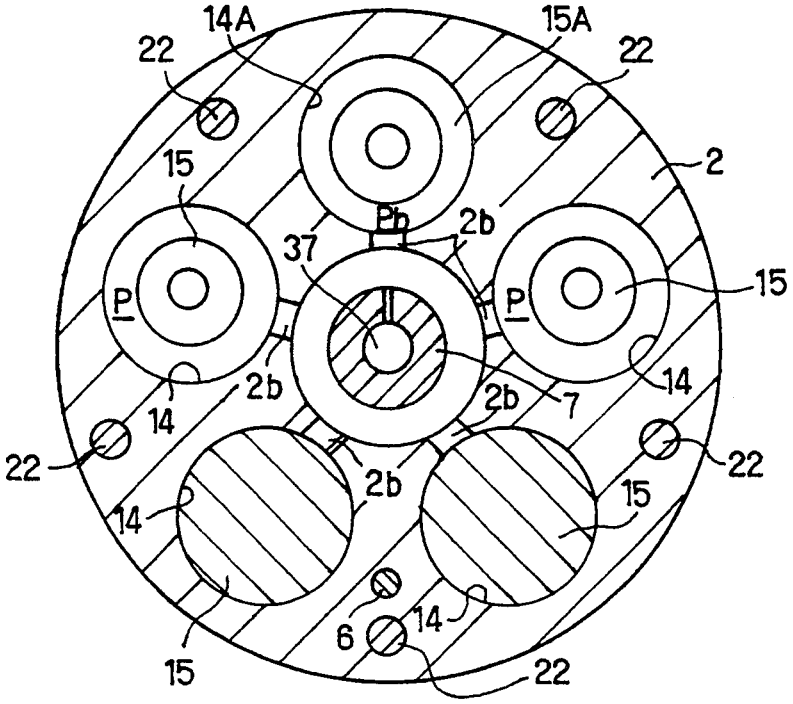
FIG. 6 is a cross-sectional view which is similar to FIG. 5, but taken along line VI—VI of FIG. 1 through the rear cylinder block.

In order to be more specific, reference is made to the state of the compressor shown in FIGS. 1, 3 and 4 where the double-headed piston 15A at the top as viewed in the drawings is located at its TDC (top dead center) with respect to the cylinder bore 13A and at its BDC (bottom dead center) with respect to the cylinder bore 14A. In this position of the piston 15A, the suction port 1*b* for the cylinder bore 13A is just about to be opened to the fluid passage 29 for communication with the swash plate compartment 11, as seen from FIG. 3, for drawing refrigerant gas into the fluid working chamber Pa in which the piston 15A is just about to move for suction stroke. On the other hand, the suction port 2*b* for the cylinder bore 14A has just been closed by the rear suction valve 28, as shown in FIG. 4. That is, the fluid passage 30 of the rear suction valve 28 has just moved past the suction port 2*b* thereby to shut communication between the swash plate compartment 11 and the fluid working chamber Pb in which the piston 15A is just about to commence its compression and discharge stroke for compressing refrigerant gas which was previously drawn into that fluid working chamber. Such suction, compression and discharge of refrigerant gas are performed in the fluid working chambers P of the other paired cylinder bores 13, 14 in the same manner as in the chambers Pa, Pb.

As apparent from the above description, the suction valve in the embodiment is free from any delay in opening as observed in the reed type suction valve and, therefore, can permit refrigerant gas in the swash plate compartment 11 to flow rapidly into the cylinder bore 13, 14 as soon as a pressure differential occurs between the swash plate compartment and the cylinder bore with the fluid passage 29, 30 then opened to the cylinder bore through the suction port 1*b*, 2*b*. Because refrigerant gas can be drawn rapidly for compression without the above-mentioned delay, the volumetric efficiency of the compressor can be improved over the aforementioned conventional one having reed type suction valves. Furthermore, because refrigerant gas under suction pressure in the swash plate compartment can be admitted into the fluid working chamber through relatively short passages 1*b*, 2*b* in the suction valves, resistance against the gas flow can be lessened as compared with that in the prior art compressor having longer passages, with the result that the pressure loss is reduced and the working efficiency of the compressor improved.

Additionally, the use of the rotary type suction valve 27, 28 can dispense with axial passages formed in the cylinder blocks for connecting front and rear suction chambers with the swash plate compartment, and the provision of the central axial discharge passage 37 in the drive shaft 7 connecting the front and rear discharge chambers 23, 24 can do away with discharge passages formed through the cylinder block assembly of the conventional compressor. Apparently, this makes it possible to dispose the cylinder bores in such an arrangement that can permit the cylinder block assembly to be constructed smaller in size than heretofore. Thus, compactness and hence lightweightness of the compressor can be accomplished without affecting its overall strength.

Now referring to FIGS. 1, 2, 5 and 6, the front and rear taper roller bearings 8, 9, the valve plates 3, 4, and the suction valves 27, 28 are disposed relative to each other such that front and rear annular spaces $S_1$, $S_2$ are formed round the drive shaft 7, respectively. These spaces $S_1$, $S_2$ are in communication with the discharge chambers 23. 24 through the bearings 8, 9 and, therefore, are filled with refrigerant gas under discharge pressure. Furthermore, the suction valves 27, 28 are located in the respective bores la, *2a* with their larger ends *27a*, *28a* slightly spaced away from the adjacent surfaces of the locating protrusions *3b*, *4b* of the valve plates 3, 4 to provide small clearances therebetween, as most clearly seen in FIG. 2. The drive shaft 7 is formed in its enlarged sections *7a*, *7b* with lubricating oil holes *7c*, *7d* formed radially and connecting the axial discharge passage 37 in the drive shaft and the spaces $S_1$, $S_2$. These holes *7c*, *7d* are drilled to be directed toward the above clearances between the suction valves 27, 28 and the valve plate protrusions *3b*, *4b*.

Because the suction valves 27, 28 are subjected at their larger ends *27a*, *28a* to relatively high discharge pressure and at the smaller ends *27b*, *28b* to lower suction pressure, the valves are urged inward along the tapered mating surfaces of the valve accommodating bores 1*a*, *2a* under the influence of such pressure differential. Thus, each suction valve can be rotated in its bore while maintaining intimate sealing contact with the bore surface.

Furthermore, part of the lubricating oil attached on the surface of the discharge passage 37 and moved with the refrigerant gas flowing therethrough can be admitted into the holes *7c*, *7d* to be splashed into the spaces $S_1$, $S_2$ under the influence of the centrifugal force created by the rotation of the drive shaft 7. Part of the splashed oil penetrates into clearances between mating surfaces of the suction valves and their accommodating bores under the influence of the above-mentioned suction-discharge pressure differential to lubricate the surfaces for smooth rotation of the suction valves. This oil can serve not only as lubricant, but also as sealant to seal the suction valve with respect to its accommodation bore. Lubricating oil fed into the spaces $S_1$, $S_2$ is also used to lubricate the tapered roller bearings 8, 9.

Should any one of the mating surfaces be worn by sliding friction therebetween after a prolonged period of use of the compressor, the suction valve can maintain good sealing contact with the bore periphery by slidably shifting inward along the drive shaft 7 only for a distance necessary to compensate for the wear. Such self-compensating capability of the suction valve is also effective to fill any gap which may be created by different expansion rates due to possible difference in expansion coefficient of the cylinder blocks and the suction valves when they are heated during compressor operation. Therefore, successful sealing can be maintained under any change in temperature during compressor operation. By making the suction valves 27, 28 of any plastic material, the compressor can be made even lighter in weight.

It is to be understood that the present invention can be embodied in other forms and modifications without departing the spirit of the invention. For example, the plurality of holes 38 may be formed so as to communicate directly with the space $S_1$. The holes 38 thus formed can perform the function of a fluid passage, as well as of an oil hole, so that the oil hole *7c* can be dispensed with and, therefore, machining of compressor part can be simplified. In such disposition of the holes 38, refrigerant gas passing through the discharge passage 37 and the holes 38 flows into the front discharge chamber 23 through clearances between the rollers *8c* and outer and inner races *8a*, *8b* of the bearing 8. Apparently, lubricating oil contained in refrigerant gas lubricates the suction valve periphery *27c*, as well as the bearing 8. It is also noted that the rotary type suction valves and their accommodating bores do not have to be necessarily tapered, but they may be cylindrically shaped. In such configuration, the clearance between the mating surfaces of the valve and its bore may be formed greater than that in the tapered configuration, but it can be filled with lubricating oil fed through the holes *7c*, *7d* to serve as sealant.

What is claimed is:

1. A swash plate type refrigerant compressor comprising:

a cylinder block having formed therein a suction compartment, a plurality of axial cylinder bores, and a pair of front and rear radially central bores, each of said cylinder bores receiving therein a reciprocally movable double-headed piston, front and rear housings clamped to axial ends of said cylinder block and having formed therein front and rear discharge chambers, respectively, communicable with said cylinder bores, a drive shaft rotatably supported in said cylinder block and having a swash plate accommodated in said suction compartment and fixedly mounted on said drive shaft at an angle of inclination so as to make a wobbling movement when driven to rotate by said drive shaft, each of said pistons being held by said swash plate by shoe means, whereby the wobbling movement of said swash plate is converted into reciprocal axial movement of each said piston in its associated cylinder bore, a pair of front and rear suction valves disposed in said front and rear radially central bores, respectively, such that opposite axial ends of each of said suction valves are subjected to suction and discharge pressures of refrigerant gas, respectively, each of said suction valves being mounted on said drive shaft for rotation therewith, having formed therein a fluid passage in communication with said suction compartment, and being operable to bring said fluid passage in communication with the cylinder bores successively in synchronism with rotation of said drive shaft, said drive shaft having formed therein an axial discharge passage in communication with said discharge chambers in said front and rear housings.

2. A swash plate type compressor according to claim 1, each of said suction valves having an outer peripheral surface in sliding contact with a peripheral surface of its associated central bore, and said drive shaft being formed with a lubricating oil hole extending radially from said discharge passage to the outer periphery of the drive shaft at a location adjacent each said suction valve.

3. A swash plate type compressor according to claim 2, said drive shaft being supported by a pair of front and rear bearings disposed axially outward of said suction valves, and said lubricating oil hole being formed at a location of the drive shaft between said each suction valve and its adjacent bearing.

4. A swash plate type compressor according to claim 3, said bearings include tapered roller bearings.

5. A swash plate type compressor according to claim 1, said drive shaft being supported by a pair of front and rear bearings disposed axially outward of said suction valves.

6. A swash plate type compressor according to claim 3, further comprising a valve plate disposed between each of said housings and its adjacent axial end of said cylinder block and having formed centrally a bore, each of said front and rear bearings being disposed in said bore of said valve plate.

7. A swash plate type compressor according to claim 1, said suction valves being tapered axially inward and said central bores being formed in complementarily tapered configuration.

8. A swash plate type compressor according to claim 7, each of said tapered suction valves having a large-diameter end facing its adjacent discharge chamber and a small-diameter end facing said suction compartment.

* * * * *